US010959522B2

(12) United States Patent
George

(10) Patent No.: US 10,959,522 B2
(45) Date of Patent: Mar. 30, 2021

(54) NO-SAFE SAFE

(71) Applicant: Dean George, Hoffman Estates, IL (US)

(72) Inventor: Dean George, Hoffman Estates, IL (US)

( * ) Notice: Subject to any disclaimer, the term of this patent is extended or adjusted under 35 U.S.C. 154(b) by 28 days.

(21) Appl. No.: 15/865,610

(22) Filed: Jan. 9, 2018

(65) Prior Publication Data

US 2019/0021496 A1 Jan. 24, 2019

Related U.S. Application Data

(60) Provisional application No. 62/444,099, filed on Jan. 9, 2017.

(51) Int. Cl.

| | |
|---|---|
| ***A47B 96/20*** | (2006.01) |
| ***A47B 81/00*** | (2006.01) |
| ***A47B 55/06*** | (2006.01) |
| *E04B 2/74* | (2006.01) |

(52) U.S. Cl.

CPC ..... *A47B 96/20* (2013.01); *A47B 81/002* (2013.01); *A47B 55/06* (2013.01); *A47B 81/005* (2013.01); *E04B 2002/7483* (2013.01)

(58) Field of Classification Search

CPC ..... A47B 96/20; A47B 81/002; A47B 55/06; A47B 81/005; E05B 2002/7483; E05G 1/026

USPC ..... 70/DIG. 81; 109/22, 23, 50–52; 312/204, 242, 245

See application file for complete search history.

(56) References Cited

U.S. PATENT DOCUMENTS 1,707,013 A * 3/1929 Hoegger ..... A47B 67/02 312/242
1,715,032 A * 5/1929 Hoegger ..... A47B 67/02 312/242
1,721,953 A * 7/1929 Hendrickson ..... A47B 67/02 49/70
1,751,107 A * 3/1930 Smith ..... A47B 67/02 49/70
1,835,042 A * 12/1931 Hammer ..... A47G 1/166 312/227
1,844,050 A * 2/1932 Wesley et al. ..... A47B 67/005 362/129
1,908,831 A * 5/1933 Edward ..... E04H 13/003 312/227
2,166,430 A * 7/1939 Green ..... A47B 67/02 49/70
2,871,083 A * 1/1959 Pokryfke ..... A62C 35/20 312/242
3,004,815 A * 10/1961 O'Kain ..... A47B 67/005 312/242
3,095,249 A * 6/1963 Albrecht ..... A47K 5/02 312/242

(Continued)

*Primary Examiner* — Lloyd A Gall
(74) *Attorney, Agent, or Firm* — Mark L. Maki; Miller Canfield

(57) ABSTRACT

A concealed storage area is disclosed that provides easily accessible and concealed in-wall storage. The storage area includes a three-dimensional storage container inserted into and secured in a wall opening, which can be covered up by a removable and/or fracturable concealing cover. The concealing cover can be painted or otherwise decorated so as to conceal the storage container or to render it more aesthetically acceptable for a particular environment.

20 Claims, 9 Drawing Sheets

(56) References Cited

U.S. PATENT DOCUMENTS 3,722,733 A * 3/1973 Neumann ..... A62C 13/78 220/602
4,155,608 A * 5/1979 Orlewicz ..... A47B 81/005 109/51
4,178,783 A * 12/1979 Lee ..... E05B 17/0062 70/422
4,304,447 A * 12/1981 Ellwood ..... A45C 11/16 312/204
4,681,380 A * 7/1987 Carlin ..... A47B 81/002 312/242
5,368,378 A * 11/1994 Curtis ..... A47B 81/00 312/204
5,410,373 A * 4/1995 Sagues ..... H04N 5/645 248/27.1
5,573,321 A * 11/1996 Bell, Jr. ..... H02G 3/123 174/481
6,092,884 A * 7/2000 Katz ..... A47B 67/005 312/225
6,363,760 B1 * 4/2002 Sigmond ..... E05G 1/00 109/50
6,480,243 B2 * 11/2002 Yamamoto ..... G06F 1/1601 312/242
7,397,461 B1 * 7/2008 Graham ..... G06F 1/20 345/156
8,109,580 B1 * 2/2012 Didier ..... G09F 19/22 312/245
8,714,665 B2 * 5/2014 Campagna ..... H05K 5/02 312/296
8,857,500 B2 * 10/2014 Tsuji ..... F24F 12/006 165/53
9,078,345 B2 * 7/2015 Campagna ..... H05K 5/02
2005/0206278 A1 * 9/2005 Gusdorf ..... A47B 96/00 312/6
2009/0026900 A1 * 1/2009 DeStefano ..... A45C 11/00 312/242
2010/0307179 A1 * 12/2010 Fava ..... F24F 1/027 62/262
2014/0103785 A1 * 4/2014 Richards ..... A47B 81/005 312/204
2017/0156499 A1 * 6/2017 Kane ..... A47B 96/20

* cited by examiner

NO-SAFE SAFE

CROSS REFERENCE TO RELATED APPLICATIONS

This application asserts priority from provisional application 62/444,099, filed on Jan. 9, 2017, which is incorporated herein by reference.

FIELD OF THE INVENTION

The invention relates generally to the field of wall and panel storage structures, and specifically to the field of structures having one or more compartments that can be concealed.

DESCRIPTION OF RELATED ART

It has long been known and desired to have a hidden, accessible area to store and retrieve items of critical importance. Such storage areas typically fall into one of two categories. Hidden, secure storage areas such as hidden wall safes and/or hidden compartments in floor boards and/or behind HVAC venting, offer secure and hidden storage, but do so in exchange for difficulty in access. To access the area, a person must not only know where to find the storage area, but must also engage in a prolonged access process, whether it be to uncover and unlock the safe, or to remove cumbersome obstacles such as floor board securing mechanisms.

On the other hand, some hidden storage areas provide easy accessibility, but sacrifice security. For example, some homeowners will keep a firearm or other weapon nearby in an easily-accessible hidden location such as a hidden rack under the bed. While access to the firearm is simple and immediate, its location can be easily uncovered by a simple visual inspection.

There are many situations in life that time and ease of access is of the essence. Seconds matter. For example, there may be a medical issue requiring an immediate need to find emergency medications. From a protection standpoint there are times where being able to timely access protection is critical. And, smaller localized emergencies can create an immediate need for concealed items. For example, many people have fire extinguishers in their home, but do not keep them in a handy location due to aesthetic or other reasons.

There is therefore a need in the art for a hidden storage area that combines simplicity of access with improved security and/or aesthetics from immediate observational inspection.

BRIEF SUMMARY OF THE INVENTION

The present invention is directed to a product or device that will allow the user to conceal or hide an item or items without detection and out of sight. The item or items can be easily accessed at any time, in case of an emergency or for any reason. After access the items can be concealed again.

Some primary advantages to this item are as follows:

It is hidden. The present invention can be concealed in a location known only to the installer. It could be high and out of reach for most, low to the ground for more to access if the installer wishes to advise others of its whereabouts, behind furniture, interior or exterior walls.

It provides extremely fast access. The present invention provides a concealed area that can be immediately physically accessed.

It is reusable. The present invention, even after access, can be easily reused repeatedly without significant effort and in a short period of time.

These and other advantages are achieved by a concealed storage area have a storage container with a three-dimensional shape creating an interior recessed area for storing items. The storage container is inserted into a wall area having a cavity behind it, so that, when inserted, the storage container is near flush with the wall surface. The storage container can preferably have a lip surrounding it as well, which can lay flush against the wall surface. Once installed, the storage container can be covered by a concealing cover that is easily removable and/or fracturable. The cover therefore both conceals the storage container, and provides immediate access to its contents.

DETAILED DESCRIPTION OF THE INVENTION

Figure 1:
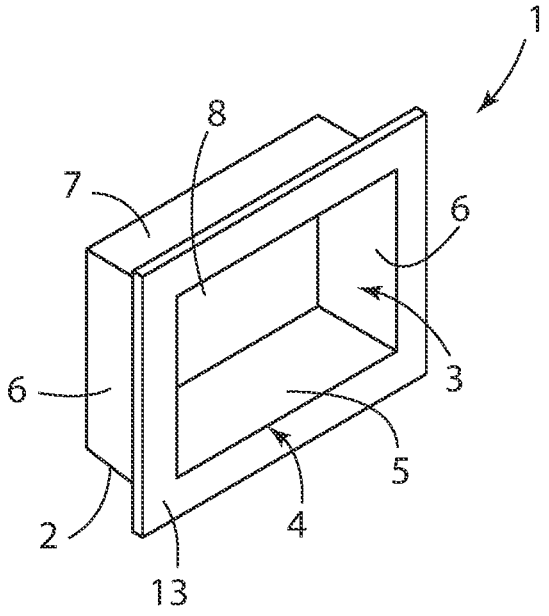
FIG. 1 shows a perspective view of the storage container of the present invention.

Referring to FIG. 1, a concealed storage area 1 in accordance with the present invention is shown. Concealed storage area 1 comprises a storage container 2 having an interior recessed area 3 and an access opening 4 through which the interior recessed area 3 of storage container 2 can be accessed. To create recessed area 3, storage container 2 is formed in any number of three-dimensional shapes, but preferably is a cuboid shape, providing side wall comprising a bottom surface 5, opposite, laterally spaced side surfaces 6, and top surface 7, and back panel 8, which extends laterally between the side surfaces 6 and generally vertically between the bottom surface 5 and top surface 7. To facilitate retention of valuables within recessed area 3, storage container 2 is preferably formed from plastic, metal, or wood to provide a rigid or semi-rigid support surface. Alternatively, storage container 2 could be made from or surrounded by insulating material if desired.

Figure 2:
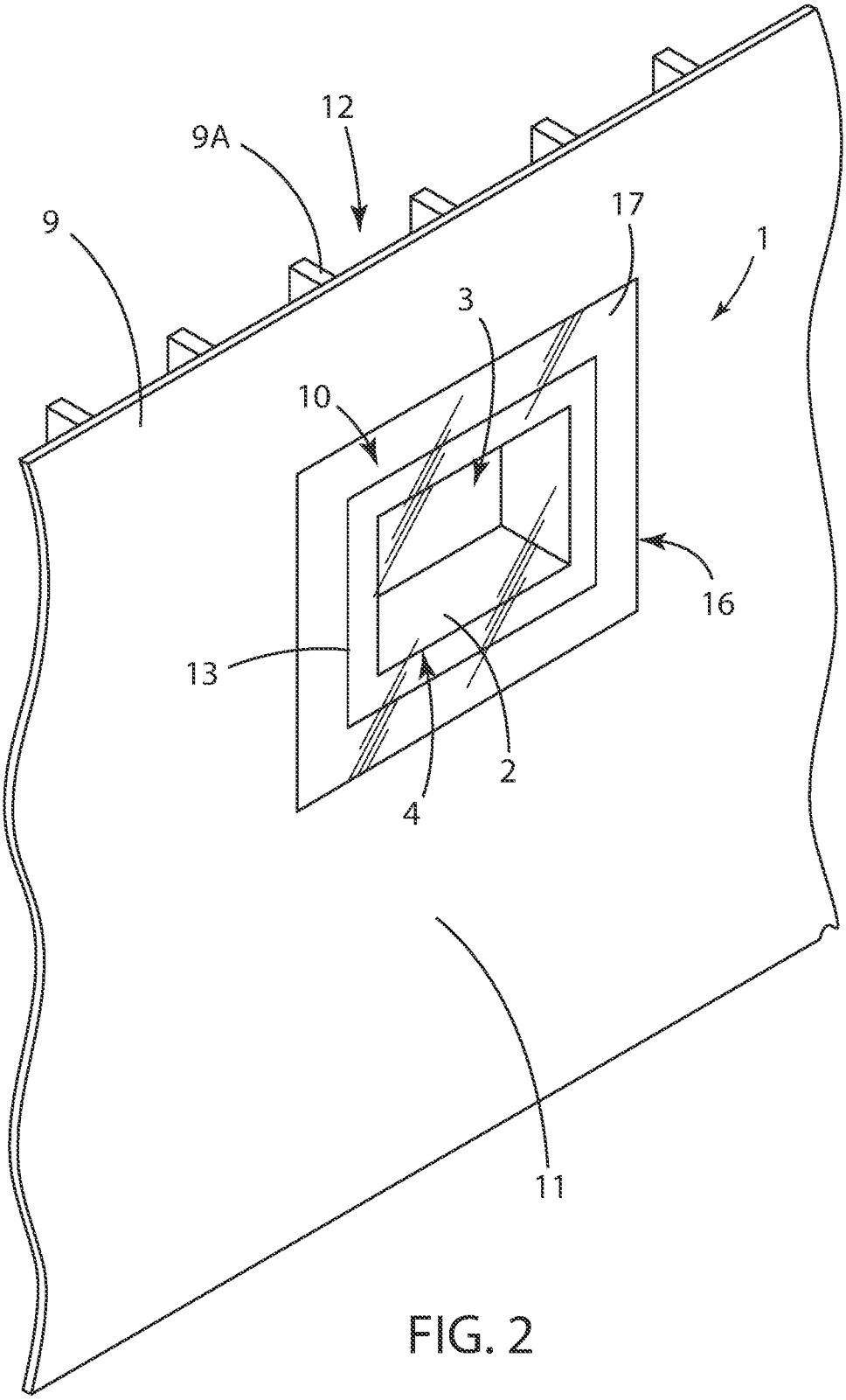
FIG. 2 shows a perspective view of the concealed storage area of the present invention, as installed.

As shown in FIG. 2, storage container 2 is retained within a wall 9 by inserting the container 2 into a recess opening 10 in the wall 9, which opening 10 has a shape corresponding to the two-dimensional cross sectional shape of the storage container 2, for example a rectangle. In a common stud wall, the wall 9 will typically comprise a wall surface 11 made of drywall, plaster, or paneling, affixed to a wall frame 9A comprising wall studs, framing, lathing, or furring strips. Wall 9 can be an interior or exterior wall of a home or business or the like, depending on the desired location for concealed storage area 1. The wall 9 normally will include a wall opening 10 and a cavity 12 behind the wall surface, which will accommodate the insertion of the container 2 into the wall opening 10. It may be necessary or desirable to create initial or additional spacing behind the wall surface 11 to accommodate insertion of the container 2, depending on the desired size or structure of container 2. Container 2 further preferably includes a lip 13 around the periphery of the access opening 4 so that, when container 2 is fully inserted into the wall opening 10 of the wall 9, lip 13 is in close proximity and preferably direct contact with the wall surface 11, and prevents container 2 from being inserted any further into recess opening 10.

Figure 3:
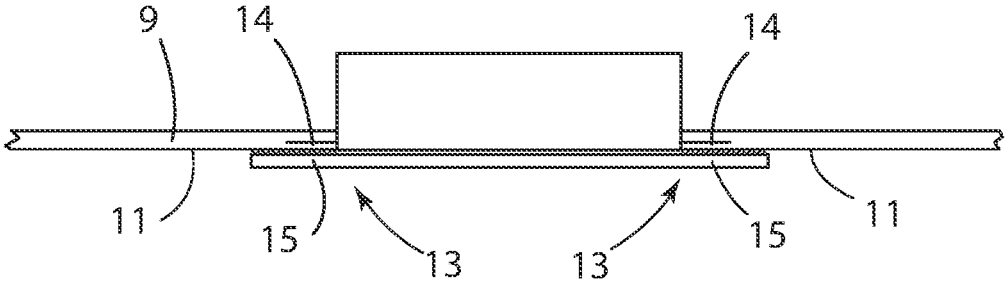
FIG. 3 shows a top cross-sectional view of the concealed storage area as installed.

Once inserted into recess opening 10, container 2 can be secured in place using any number of means known to those of skill in the art. In a preferred embodiment, container 2 includes clips 14 (shown in FIG. 3) connected to container 2, and used to secure connection to wall 9. Clips 14 are shown inserted into, for example, an edge of the wall opening 10 and, for example, within the middle gypsum portion of drywall in order to secure container 2 in place. Clips 14 could similarly be used to create a resistance fit between container 2 and wall 9 by being placed between container 2 and wall 9, such as opposing side surfaces of the container 2 and wall opening 10, or by being placed so as to press against the back side of wall 9 and, in turn, pull lip 13 into tighter contact with wall surface 11. Lip 13 may similarly include an adhesive 15 or other securing means to secure attachment to wall surface 11. Once the container 2 is mounted to the wall 9, the access opening 4 of the container 2 is accessible from a front side of the container 2.

Figure 4:
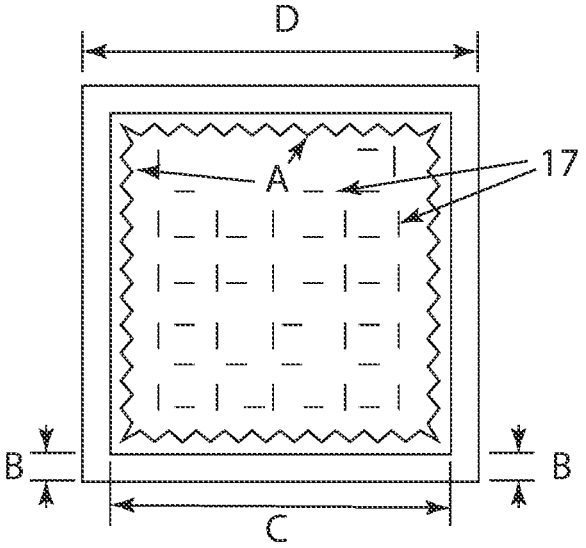
FIG. 4 shows a top view of the concealing cover, including: non-permanent adhesive A, tapered edge B, concealing cover material 17 with partial cross sectioned perforation, 70-80% depth of material, with inside dimension C; and full size edge to edge D.

To hide access opening 4, concealed storage area 1 further includes concealing cover 16 (FIGS. 2, 4 and 5), which extends beyond and covers over access opening 4 and lip 13, hiding interior recessed area 3 from view. Concealing cover 16 is preferably constructed from an easily-paintable, fracturable cover material C such as paper with cross sectioned perforation, and can be provided pre-primed for painting. Preferably, cover 16 has a tapered edge B around its periphery of, for example, ¼ inch thickness, to assist in diminishing the visual appearance of concealing cover 16. Concealing cover 16 is secured in place around access opening 4 using an adhesive A, permanent or non-permanent depending on the desired application. Once so installed, a user can access the interior recessed area 3 by fracturing the concealing cover 16 (fracturing made easier and cleaner due to the cross sectioned 70-80% perforation of the cover material 16) or removing the cover 16, to retrieve items from the container 2. If cover 16 is fractured, it can be easily replaced with a new concealing cover 16 of the same or larger size. If the concealing cover 16 is removed, it can be re-attached with either the existing attachment method, such as the adhesive A, or by adding additional securing means such as adhesive, which may be reapplied. In an alternative embodiment, if a user desires to secure items but leave them visible (for example, for trophies or the like), the concealing cover 16 can be made of a transparent material (Non-perforated), wherein the transparent material is represented by the cover material A described above. In still a further alternative embodiment, if a user wishes to mark the location of the concealing cover 16, they can do so on or near the concealing cover 16 and surrounding wall surface 11, by, for example, including an icon or other indicator identifying the storage area.

Figure 5:
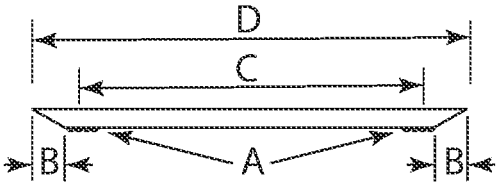
FIG. 5 shows a side view of the concealing cover of FIG. 4.
Figure 6:
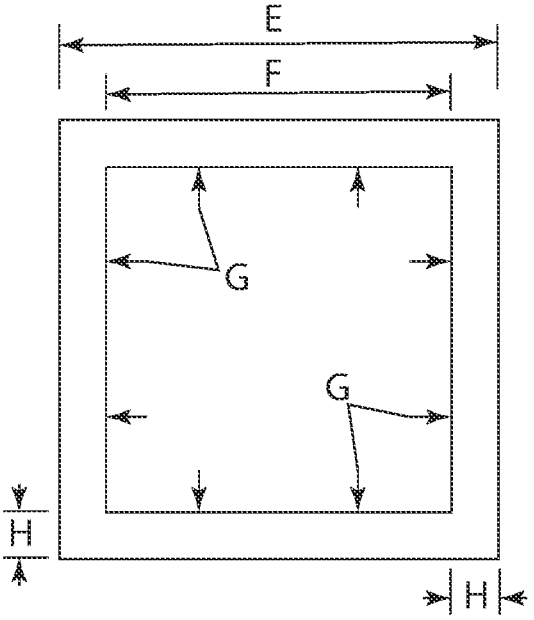
FIG. 6 shows a top view of the storage container, including: full size outer edge of box E; inside box F; mounting clips G; ¼ mounting lip H; and box depth I.
Figure 7:
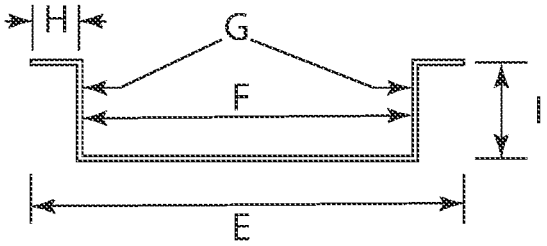
FIG. 7 shows a side view of the storage container of FIG. 6.

Referring to FIGS. 5 and 6, the size of the container 2 can be selected based on the desired items to be stored. Preferably, storage container 2 is a cuboid six inches tall, six inches wide (inside box F by F) across the access opening 4, and 3.5 inches deep (box depth I), having a lip 13 extending ¼ inch H beyond the periphery of access opening 4 to define a maximum size of 6.5 inches (full size outer edge of box E by E). With such a size, a concealing cover 16 that is 6.5 inches wide and 6.5 inches tall (D by D) will adequately cover both access opening 4 and lip 13 measuring E by E. In this regard, the inside dimension C of the cover 16 generally aligns with the dimensions F by F of the access opening 4. With this size, concealing cover 16 including the cover material 17 can be easily painted using a standard 9-inch paint roller. Larger and smaller container 2 sizes are contemplated as well. For example, a container 2 having a three-inch by three-inch access opening 4 could be ideal for concealing an extra set of car keys. Or, a larger container having a one-foot by one-foot access opening 4 could be used to conceal a firearm in a secure location. Depending on the size of access opening 4, additional reinforcement for concealing cover 16 may be necessary to ensure a smooth, consistent surface, such as, for example, a reinforced paper portion, or a portion having a small wooden dowel or slat.

To install a concealed access area 1 in accordance with the present invention, the first step is to select a storage container 2 and installation location appropriate for the items to be concealed. Because concealed access area 1 can be installed nearly anywhere, the storage location can be selected based on convenience and utility. For example, a concealed access area 1 for storing spare vehicle keys can be placed near an exit door near the floor or at the height of a standard person. Or a concealed access area 1 for storing a firearm can be placed at a closet location at a tall height to avoid children accessing the area. Other locations, sizes, and uses can be contemplated by those of ordinary skill in the art.

Once a storage container 2 size and location is selected, the recess opening 10 can be created in the wall. For example, if a storage container 2 is selected having a six-inch by six-inch access opening, a similar six-inch by six-inch recess opening 10 can be created in the wall 9. Once created, container 2 can be inserted into the recess opening 10, and secured therein using clips 14, adhesive 15, and/or other securing means, either individually or cooperatively.

After storage container 2 is installed and secured, the items to be stored are inserted into the interior recessed area 3. Once inserted, the concealing cover 16 can be installed, covering and securing the interior recessed area 3 and the access opening 4. Thereafter, if desired, concealing cover 16 can be painted to match the texture and/or color of the surrounding wall surface 11, further concealing the concealed storage area 1. Depending on the application and the type of paint used, painting the concealing cover 16 may take one or several coats of paint, or concealing cover 16 may come pre-painted or decorated in a manner that does not require further painting by user.

Following installation, the items in the concealed storage area 1 can be accessed at any time by removing and/or fracturing the concealing cross sectioned perforated cover 16, revealing the interior recessed area 3, and allowing access to its contents. (Note: the cross sectioned 70-80% perforation of the cover material 17 allows for a cleaner and easier breach for access to the contents).

Exemplary uses for this invention includes, but are not limited to:

A secure key or code small safe can be incorporated into the box at least ⅛ of an inch below the Paintable Primed Material. This product will offer complete concealment. If the safe can't be found it cannot be compromised.

Weapons for security (pepper spray, stun gun, hand gun).

Money.

Medicines (Epi-pen, rescue inhalers, allergy medicine, emergency heart medicine such as aspirin or Nitroglycerin, etc.)

Important papers or documents

Keepsakes/Time Capsule

Used for children's hiding games

Fire Extinguishers (install in or near kitchen but put a decorative or noticeable ICON so that it is viewable just not in plain sight for cosmetic reasons)

Have the Paintable Primed Material be transparent so that items can be visible (Trophies, Awards, Wines or Cordials, Antique items, displayed Glass or Stem ware).

Figure 8:
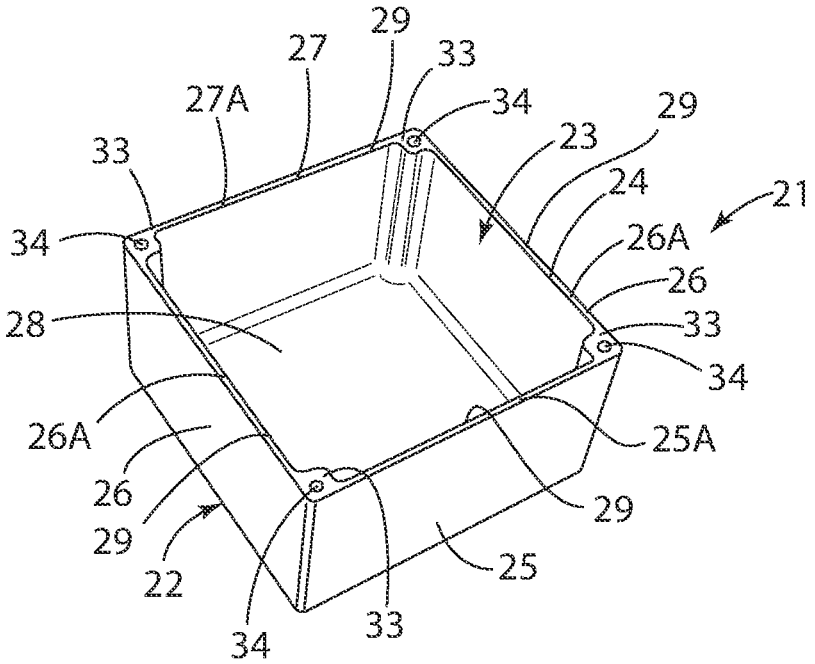
FIG. 8 shows a side perspective view of a second embodiment of the storage container.

Next, a second embodiment of the present invention is disclosed as follows which embodiment contains various improvements to the above-described invention. FIG. 8 shows a side perspective view of a second embodiment of the concealed storage area 21, which comprises a storage container 22 having an interior recessed area 23 and an access opening 24 through which the interior recessed area 23 of storage container 22 can be accessed. To create recessed area 23, storage container 22 is formed in any number of three-dimensional shapes, but preferably is a cuboid shape in this second embodiment, providing side wall comprising a bottom surface 25, opposite, laterally spaced side surfaces 26, and top surface 27, and back panel 28, which extends laterally between the side surfaces 26 and generally vertically between the bottom surface 25 and top surface 27. To facilitate retention of valuables within recessed area 23, storage container 22 is preferably formed from plastic, metal, or wood to provide a rigid or semi-rigid support surface.

In accord with the above description of FIGS. 1-7, storage container 22 is similarly retained within a wall 9 by inserting the container 22 into a recess opening 10 in the wall 9, which opening 10 has a shape corresponding to the two-dimensional cross sectional shape of the storage container 22, for example a rectangle. In a common stud wall as previously described, the wall 9 will typically comprise a wall surface 11 made of drywall, plaster, or paneling, affixed to a wall frame 9A comprising wall studs, framing, lathing, or furring strips. Wall 9 can be an interior or exterior wall of a home or business or the like, depending on the desired location for concealed storage area 20. The wall 9 normally will include a wall opening 10 and a cavity 12 behind the wall surface, which will accommodate the insertion of the container 2 into the wall opening 10. It may be necessary or desirable to create initial or additional spacing behind the wall surface 11 to accommodate insertion of the container 22, depending on the desired size or structure of container 22.

While the container 22 further preferably may include a lip around the periphery of the access opening 24 like lip 13 described above, the container 22 of this second embodiment might omit such lip to further facilitate concealability. In this regard, the bottom surface 25, opposite, laterally spaced side surfaces 26, and top surface 27 can extend and terminate at respective surface edges 25A, 26A and 27A that define forward facing edge faces 29. When container 22 is fully inserted into the wall opening 10 of the wall 9, edge faces 29 terminate in close proximity but are spaced interiorly of the wall surface 11 so that the edge faces 29 do not project outwardly beyond the wall surface 11.

Figure 10:
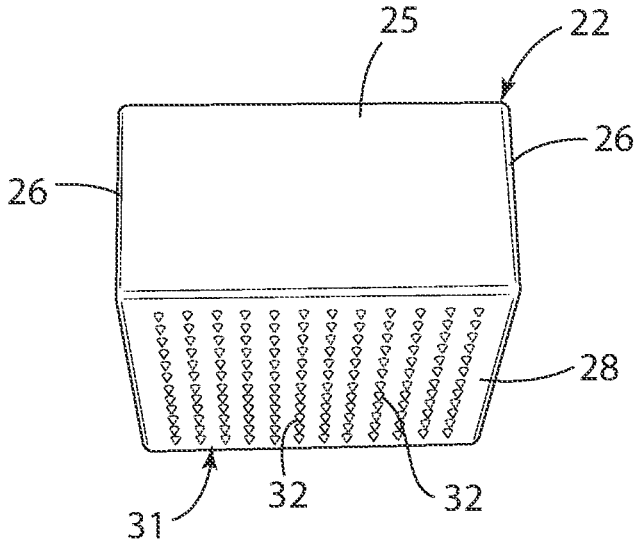
FIG. 10 shows a bottom perspective view thereof.
Figure 11:
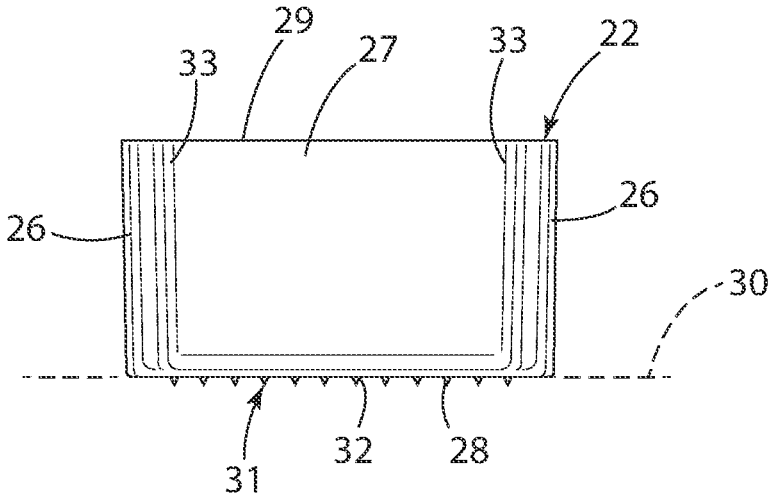
FIG. 11 shows a front cross-sectional view thereof.

Notably, the bottom surface 25 may rest downwardly on the bottom edge of the access opening 10 so that the wall provides vertical support to the storage container 22. Referring to FIGS. 10 and 11, the bottom panel 28 preferably is configured to abut against an interior structure 30 of the wall 9, which provides support to the storage container 22. This interior wall structure 30 typically is enclosed after construction but becomes exposed once the access opening 10 is formed or cut through the wall surface 11. While the interior structure 30 will again be covered by the storage container 22 after installation, the bottom surface 28 of the storage container 22 includes support structure 31 that projects outwardly and fixedly engages with the wall structure 30 to limit insertion of the storage container 22 into the access opening 10 and vertically support the bottom panel 28. Preferably as seen in FIGS. 10 and 11, the bottom panel 28 includes an array or plurality of support barbs 32, which project outwardly and are configured to pierce the wall structure 30 as generally seen in FIG. 11. For example, the barbs 32 may pierce the interior face of a wallboard or wall panel that covers the side of the wall 9 opposite to the wall surface 11. Hence, this wall structure 30 prevents the inboard container end defined by bottom panel 28 from sagging after installation. Additionally, the outboard container end defined at the bottom side 25 can be supported on the wallboard or other wall structure forming the wall surface 11. If desired, other support structure might be provided on the storage container 22 to engage with wall structure and vertically support the weight of the storage container 22.

Once inserted into recess opening 10, container 22 can be secured in place using any number of means known to those of skill in the art. As described above, container 22 might include clips 14 (shown in FIG. 3) that could be connected to container 22, and used to secure connection to wall 9. Once the container 22 is mounted to the wall 9, the access opening 24 of the container 22 is accessible from a front side of the container 22.

Figure 9:
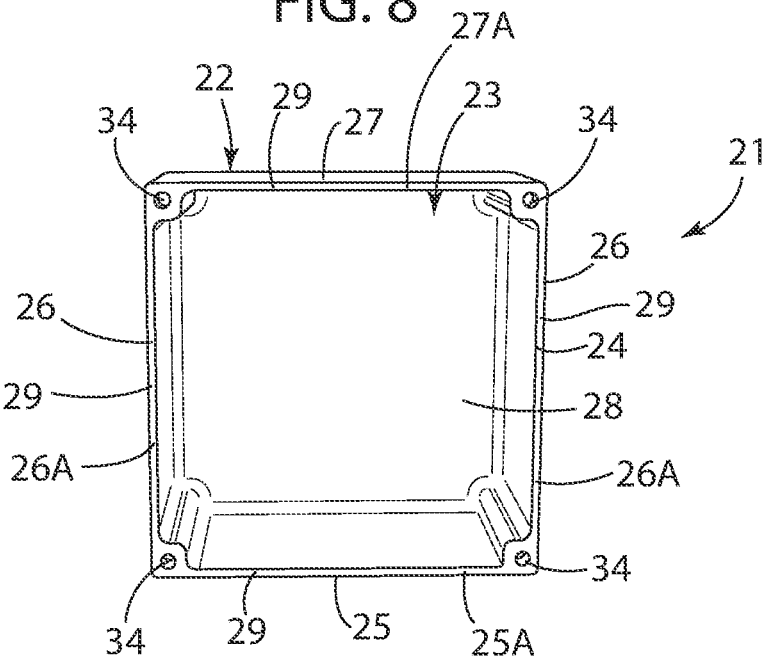
FIG. 9 shows a top perspective view of the storage container.

Referring to FIGS. 8 and 9, the corners of the storage container 22 are included with a gusset-like corner support 33 which includes connector formations 34 that are preferably formed as blind bores. The connector formations 34 open forwardly and accessible through the access opening 10 of the wall 9.

Figure 12:
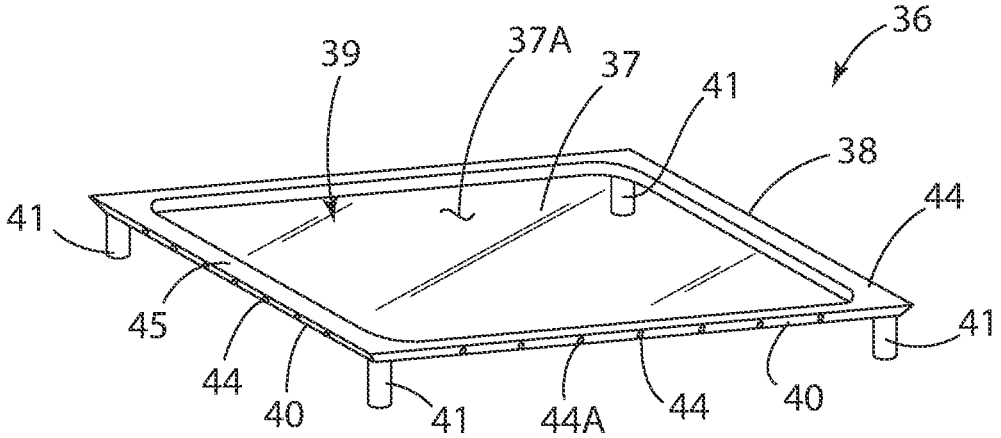
FIG. 12 shows a top perspective view of a concealing cover of the second embodiment.
Figure 13:
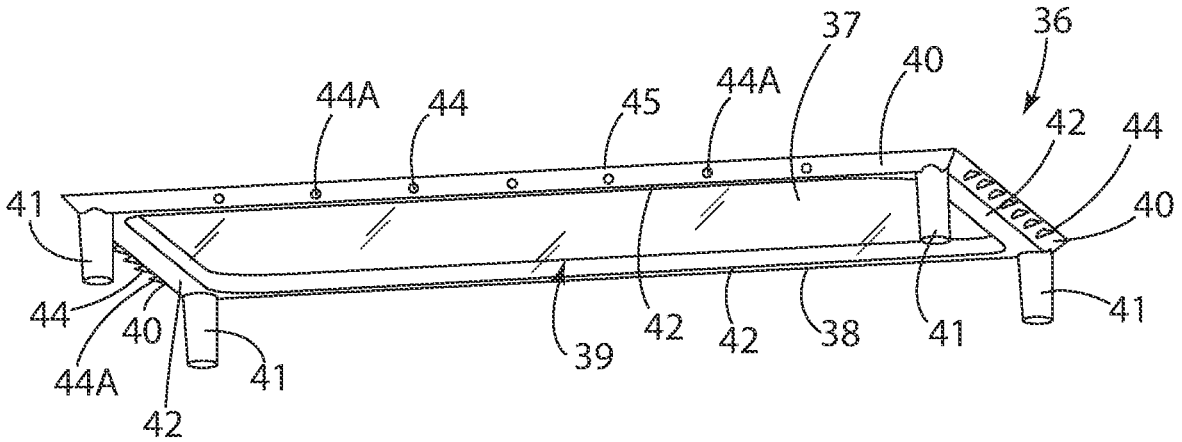
FIG. 13 shows a bottom perspective view of a concealing cover of the second embodiment.
Figure 14:
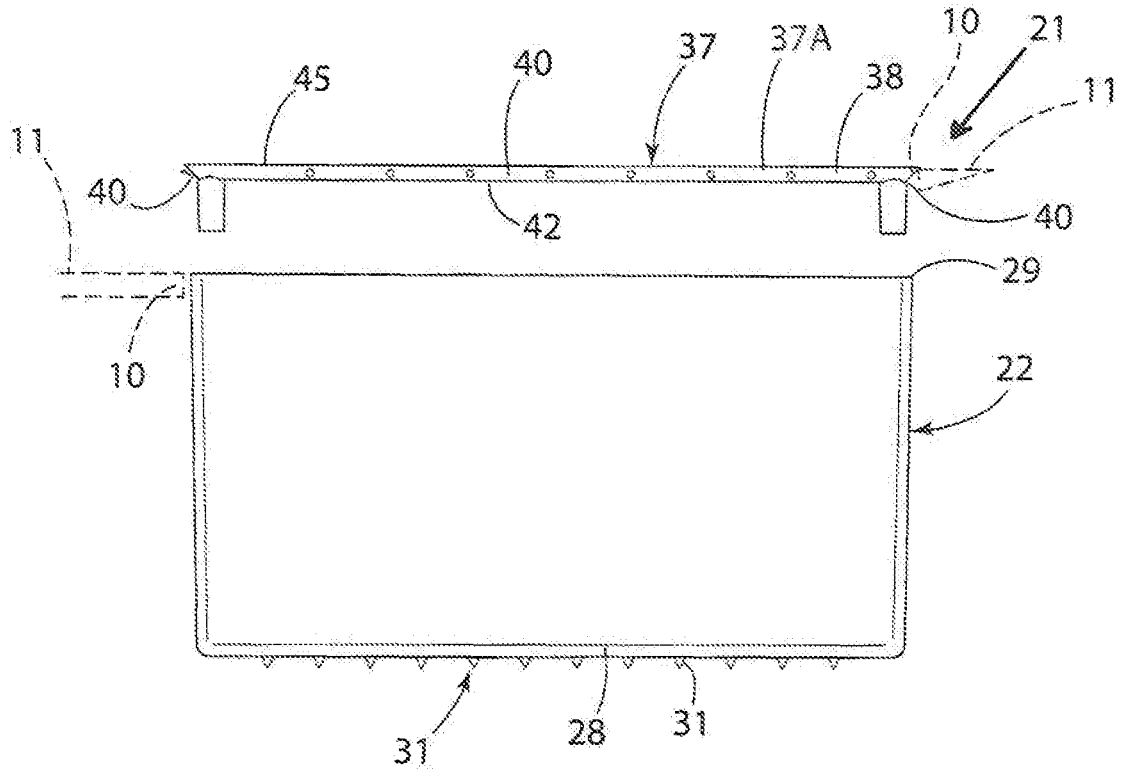
FIG. 14 is a front exploded view of the storage container and concealing cover prior to assembly.

To hide the container access opening 24, concealed storage area 21 further includes concealing cover 36 (FIGS. 12, 13 and 14), which extends over and covers access opening 24 thereby hiding the interior recessed area 23 from view. Concealing cover 36 is preferably constructed from an easily-paintable, fracturable cover material 37 such as a formed material such as plaster of paris, although the cover material 37 could be paper with a cross sectioned perforation, and can be provided pre-primed for painting.

The concealing cover 36 comprises a peripheral frame 38 which forms an interior opening 39 that generally corresponds with the access opening 24 but is covered by the cover material 37 during use. Preferably, the peripheral frame 38 of the cover 36 has a tapered edge 40 around its periphery to assist in diminishing the visual appearance of concealing cover 36.

The concealing cover 36 is secured to and aligned with the storage container 22 by a plurality of corner connectors 41 preferably formed as connector posts that insert into the corresponding corner connector formations 34 formed on the storage container 22. While the posts 41 and bores 34 may be sufficiently tight so as to hold together, a separate adhesive might be provided between the container edge surface 29 and an interior surface 42 on the peripheral frame 38. The adhesive could be continuous about the entire periphery defined by the peripheral frame 38 or may be spaced apart adhesive tabs.

Also, the tapered edges 40 include connector structure 44 preferably formed as a plurality of peripheral spaced barbs 44A. These barbs 44A project sidewardly so as to engage the edges of the wall access opening 10 such as by embedding into the gypsum of the wallboard that forms the wall 9. The concealing cover 36 may be dimensioned so as to define an exterior frame surface 45 that preferably lies close to or flush with the wall surface 11. The frame surface 45 may also project laterally a small distance beyond the storage container 22 so as to overlap a small portion of the wall surface 11, for example, to hide outer edges of the wall access opening 10. If desired, a suitable joint material might be coated over any joint to smooth the joint between the wall opening 10 and the peripheral frame 38, and possibly smoothly transition the wall surface 11 into the surface 37A defined by the cover material 37.

Figure 15:
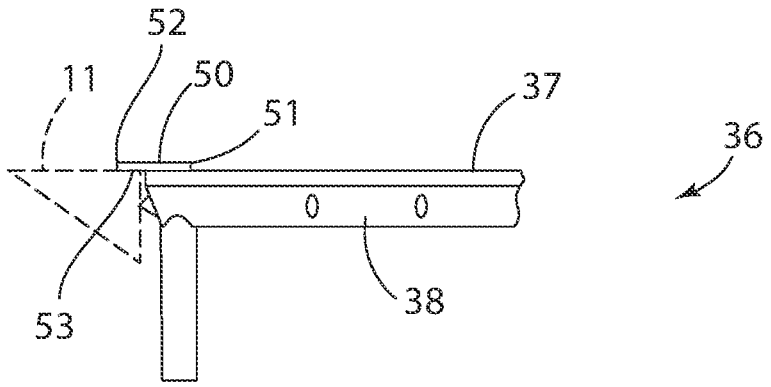
FIG. 15 is an enlarged partial front view of the concealing cover.
Figure 16:
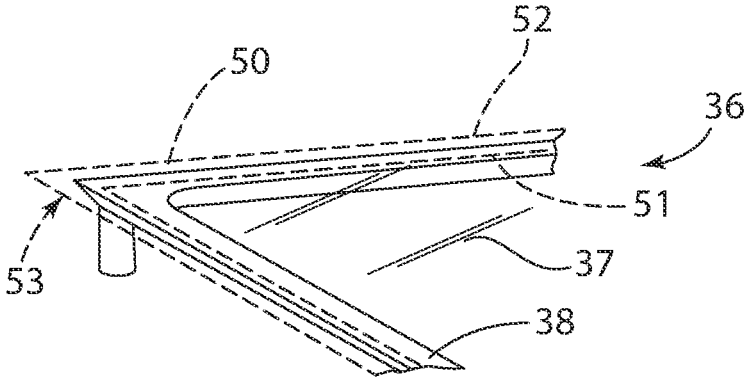
FIG. 16 is an enlarged partial perspective view of the concealing cover.

Referring to FIGS. 15 and 16, the peripheral frame 38 is shown with the cover material 37 joined thereto. In the preferred embodiment, the cover material 37 is a formed, hardened material such as plaster of paris, which is molded into a shape that corresponds to the peripheral frame 38. During manufacture, the cover material 37 may be filled in a mold so as to have a thin, fracturable thickness, and then the peripheral frame 38 may be joined to or set in the cover material 37 to solidly enclose the opening 39 within or bounded by the peripheral frame 36. As seen in FIG. 15, the cover material 37 lies closely aligned or at least substantially flush with the wall surface 11. After setting of the cover material 37, the cover material 37 can be prefinished by sanding, priming or the like, so as to facilitate final cover coating once wall installation is complete.

Preferably, the cover material 37 can include an edge extension 50 that extends outwardly beyond the peripheral frame 38 so as to cover any visible joint lines or cut lines in the wall material of the wall surface 11. The edge extension 50 preferably is formed of a thin, flexible paper that has an inner edge 51 joined to the cover material 37 in overlapping relation, and an outer edge 52 that is spaced outwardly of the peripheral frame 38 so as to overlie or span any wall joint. Additionally, the outer edge 52 can include an adhesive or other connector material 53 that fastens to the wall surface 11. The connector material 53 can be covered by a removable strip during shipping, which strip is removable during installation to expose the adhesive 53. The adhesive 53 is then pressed to the wall surface 11 to cover any wall joints. Thereafter, the entire cover material 37 including any edge extension 50 can be finished such as by spackle, primer and/or paint to hide any visible indications of the storage area 21 being present in the wall 9.

The storage area 21 or even storage area 1, can be sold as kit if desired comprising, for example, the container 22 and a plurality of concealing covers 36. The covers 36 can each be formed with the same peripheral frame 38 and cover material 37, but may differ in that the edge extension 50 may be progressively wider in each of the covers 36. For example, the edge extension 50 might be 0.5 inches wide on a first cover 36 that that is used first. Once the first cover 36 is broken and removed, a second cover 36 can have a wider width for the extension 50, such as 0.75 inches, to cover up any signs of the first cover that has been removed. A third cover 36 can have an even wider edge extension 50, such as 1.0 inches, to in turn cover over signs of the second cover 36 after the second cover 36 has been used and removed. Each of the progressively wider edge extensions 50 is similar in that it can be readily covered over such as by painting.

Once so installed, a user can access the interior recessed area 23 by fracturing the concealing cover 36 or removing the cover 36, to retrieve items from the container 22. If cover 36 is fractured, it can be easily replaced with a new concealing cover 36 of the same or larger size which includes an unbroken cover material 37. If the concealing cover 36 is removed, it can be re-attached with either the existing attachment method, or by adding additional securing means such as adhesive. In an alternative embodiment similar to the above-disclosure, if a user desires to secure items but leave them visible (for example, for trophies or the like), the concealing cover 36 can be made of a transparent material.

After storage container 22 is installed and secured, the items to be stored are inserted into the interior recessed area 23. Once inserted, the concealing cover 36 can be installed, covering and securing the interior recessed area 23 and the access opening 24. Thereafter, if desired, concealing cover 36 can be painted to match the texture and/or color of the surrounding wall surface 11, further concealing the concealed storage area 1. As referenced above, joint compound might be added to further disguise any visible joint between the concealing cover 36 and wall surface 11 if such is desirable.

The invention claimed is:

1. In a concealed storage area assembly mountable in a structural wall, said concealed storage area assembly comprising:

a storage container having an interior recessed area and an access opening through which said interior recessed area can be accessed, said storage container comprising a container wall having a plurality of wall surface sections that define a wall periphery that defines a shape of said access opening wherein said container wall is configured to fit within a wall opening of the structural wall, said container wall defining a front edge configured to be disposed proximate a wall surface of the structural wall wherein said front edge is exposed on a front side of said storage container; and a concealing cover comprising a frame mountable to said storage container and a cover material which overlies and spans said access opening to enclose said access opening when said concealing cover is supported on said storage container, said frame comprising a peripheral edge having a frame periphery corresponding to said wall periphery so that said frame covers each of said wall surface sections of said container wall, said cover material being immovably fixed to said frame so that said cover material is immovable relative to said storage container, and said frame including securing means disposed continuously or at spaced apart locations about an entire length of said frame periphery of said peripheral edge so as to join said frame to each of said wall surface sections for securing said concealing cover in a fixed position on said storage container, said cover material being immovable when said concealing cover is secured in said fixed position on said storage container and being formed of a fracturable material to permit fracturing and access to said access opening.

2. The storage area assembly according to claim 1, wherein said concealing cover comprises a paintable, fracturable cover material wherein said fracturable cover material has a cross-sectional perforation to facilitate fracturing.

3. The storage area assembly according to claim 2, wherein said cover material comprises at least one of a sheet of paper or fracturable cast material that spans said frame.

4. The storage area assembly according to claim 2, wherein said frame comprises a peripheral frame structure which extends along said edge of said container wall and defines an opening which is enclosed by said cover material, said securing means comprise corner connectors on said frame which engage with each of said wall surface sections on said storage container.

5. The storage area assembly according to claim 1, wherein said concealing cover includes a finish material that is fixed to an exterior of said concealing cover after installation of said concealing cover on said storage container to hide said concealing cover.

6. The storage area assembly according to claim 5, wherein said finish material matches at least one of a texture and color of a surface finish of said wall surface.

7. The storage area assembly according to claim 1, wherein said frame comprises a peripheral frame structure which extends along said edge of said container wall and defines an opening which is enclosed by said cover material so as to lie substantially flush with a wall surface, said frame including an edge section which extends outwardly of said peripheral frame to overlie an interface with the structural wall.

8. The storage area assembly according to claim 1, wherein said storage container includes connector structure which is engagable with a structural wall to support said storage container within a wall opening.

9. The storage area assembly according to claim 8, wherein said connector structure comprises an adhesive joinable with the structural wall.

10. The storage area assembly according to claim 8, wherein said connector structure comprises projections which engage with the structural wall.

11. The storage area assembly according to claim 1, wherein said storage container further includes a lip around a periphery of said access opening so that said lip is in close proximity with the wall surface.

12. The storage area assembly according to claim 1, wherein said storage container is provided in combination with at least two said concealing covers of different sizes wherein en-only one of the two said concealing covers is mountable to said storage container at a time.

13. The storage area assembly according to claim 1, wherein said storage container is dimensioned from said front edge to a back edge so as to be proximate a wall thickness into which said storage container is inserted.

14. In a storage area assembly which is provided in and concealed within a structural wall, said storage area assembly comprising:

a storage container having an interior recessed area and an access opening through which said interior recessed area can be accessed, said storage container comprising a container wall having a plurality of wall surface sections that define a wall periphery and define a shape of said access opening, said container wall configured to fit within a wall opening of said structural wall, said container wall defining a front edge configured to be disposed proximate a wall surface of the structural wall wherein said front edge is exposed on a front side of said storage container; and a concealing cover comprising a peripheral frame mountable to said storage container, said peripheral frame defining a frame opening which aligns with said access opening and including a cover material which overlies and spans said access opening to enclose said access opening when said concealing cover is supported on said storage container, said peripheral frame comprising a peripheral edge defining a frame periphery corresponding to said wall periphery so that said frame covers said container wall and said frame periphery extends about said access opening, said cover material being immovably supported on said frame so that said cover material is immovable when mounted over said access opening, and said frame including securing means disposed continuously or at spaced apart locations about an entire length of said frame periphery of said peripheral edge so that said frame is secured to each of said wall surface sections for securing said concealing cover in a fixed position on said storage container to hide said wall opening, said cover material being immovable when said concealing cover is secured in said fixed position on said storage container and being formed of a fracturable material to permit fracturing and access to said access opening, said concealing cover having said peripheral edge which extends outwardly of said peripheral frame and is fastenable to said structural wall to hide said wall opening and prevent access to said access opening, said cover material comprising at least one of a sheet of paper, or a fracturable material that spans said frame wherein access is provided by puncturing through said cover material.

15. The storage area assembly according to claim 14, wherein said concealing cover comprises a paintable, fracturable cover material wherein said fracturable cover material has a cross-sectional perforation to facilitate fracturing.

16. The storage area assembly according to claim 14, wherein said concealing cover includes a finish material that is fixed to an exterior of said concealing cover after installation of said concealing cover on said storage container to hide said concealing cover.

17. The storage area assembly according to claim 16, wherein said finish material matches at least one of a texture and color of a surface finish of said wall surface.

18. The storage area assembly according to claim 14, wherein said frame includes an edge section which extends outwardly of said peripheral frame to overlie an interface with the structural wall, and said securing means comprise a plurality of connectors that engage with each of said wall surface sections.

19. The storage area assembly according to claim 18, wherein said storage container includes connector structure which is engagable with a structural wall to support said storage container within a wall opening.

20. The storage area assembly according to claim 19, wherein said connector structure comprises an adhesive joinable with the structural wall.

* * * * *